United States Patent [19]

Hidaka et al.

[11] Patent Number: 4,538,565

[45] Date of Patent: Sep. 3, 1985

[54] LUBRICANT PASSAGE SYSTEM FOR INTERNAL COMBUSTION ENGINES

[75] Inventors: Yoshiaki Hidaka; Hiroshi Shinagawa, both of Saitama, Japan

[73] Assignee: Honda Giken Kogyo Kabushiki Kaisha, Tokyo, Japan

[21] Appl. No.: 553,860

[22] Filed: Nov. 18, 1983

[30] Foreign Application Priority Data

Nov. 24, 1982 [JP] Japan ..... 57-205822

[51] Int. Cl.[3] ..... F01M 1/00

[52] U.S. Cl. ..... 123/196 R; 123/195 R; 184/6.5

[58] Field of Search ..... 123/195 R, 195 C, 196 R, 123/196 M, 196 A; 184/6.4, 6.5, 6.8, 6.24

[56] References Cited

U.S. PATENT DOCUMENTS

| | | | |
|---|---|---|---|
| 2,118,283 | 5/1938 | Winslow | 184/6.8 |
| 2,963,006 | 12/1960 | Karde | 123/195 A |
| 3,127,586 | 3/1964 | Heyn et al. | 184/6.4 |
| 3,949,725 | 4/1976 | Jaulmes | 123/196 R |
| 3,961,614 | 6/1976 | Rameau | 123/195 A |
| 3,973,548 | 8/1976 | Celli | 123/195 R |

OTHER PUBLICATIONS

*Diesel Engineering Handbook*—Stenson 11th Ed. 1963, p. 335.

*Fundamentals of Internal Combustion Engines* Gill et al., 1959, pp. 1-12.

*Primary Examiner*—E. Rollins Cross

*Attorney, Agent, or Firm*—Lyon & Lyon

[57] ABSTRACT

A pump for lubricating oil is mounted on the outer face of the end wall of an internal combustion engine. An oil filter is mounted on a side wall of the engine parallel to the crankshaft, and a substantially straight sub-gallery in the side wall connects the oil pump to the oil filter. A substantially main gallery receives lubricating oil from the oil filter and delivers it to branched oil supply passages to lubricate parts of the engine.

1 Claim, 6 Drawing Figures

LUBRICANT PASSAGE SYSTEM FOR INTERNAL COMBUSTION ENGINES

The present invention relates to a lubricant passage system for lubricating portions of an internal combustion engine such as the bearing portions of the crankshaft or the bearing portions of a valve actuating mechanism.

In an internal combustion engine, generally speaking, the engine body is equipped with a lubricating oil pump and an oil filter and is formed in itself with an oil gallery so that a lubricant pumped by the oil pump is fed, after it has been filtered by the action of the oil filter, by way of the oil gallery to a plurality of branched oil supply passages. In this way lubricant is supplied to those portions to be lubricated. Despite this fact, there arises a disadvantage that the oil gallery formed in the engine body generally has its shape complicated to raise the production cost of the engine itself.

The present invention has been conceived in view of that background and has a principal object to provide a lubricant passage system for an internal combustion engine in which both a sub-gallery for providing communication between the discharge port of an oil pump and the inlet of an oil filter, and a main gallery for providing communication between the outlet of the oil filter and a plurality of branched oil supply passages are formed in the side wall of the engine body. The sub-gallery and the main gallery are generally in a straight form in parallel with the crankhaft and have their shapes so simplified that they can be easily formed, and so that their strengths may be increased without causing any increase in the weight of the engine body.

In order to achieve the above-identified object, a lubricant passage system for an internal combustion engine is constructed in a manner so that the engine body is equipped with a lubricating oil pump on the outer face of its end wall normal to a crankshaft, and having an oil filter on the outer face of its side wall parallel to said crankshaft. Said side wall of said engine body is formed generally in parallel with said crankshaft with both a straight sub-gallery for providing communication with the discharge port of said oil pump and the inlet of said oil filter, and a straight main gallery having communication with the output of said oil filter. The main gallery is made to communication with a plurality of branched oil supply passages which extend to the portions of the engine to be lubricated.

The present invention is described in the following in connection with one embodiment thereof with reference to the accompanying drawings.

Figure 1:
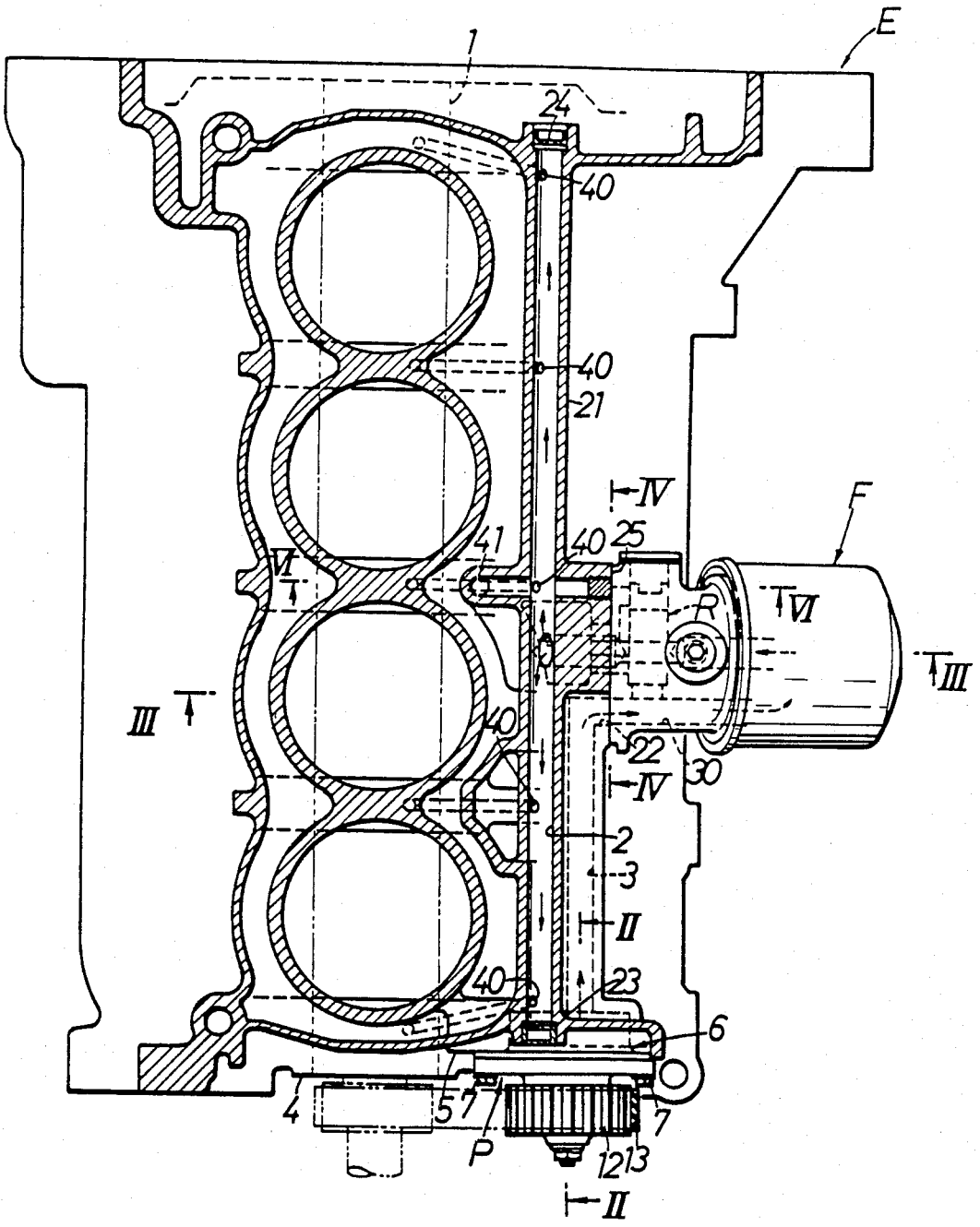
FIG. 1 is a sectional plan view showing a preferred embodiment of this invention.

Referring to the drawings, a lubricant passage system for lubricating parts within an engine body E is schematically described with reference to FIG. 1. A lubricating oil pump P to be driven by a crankshaft 1 is secured to an end face of the body E of a four-cylinder internal combustion engine which is normal to the direction of the crankshaft 1. Lubricating oil within an oil pan is pumped from that oil pump P to a sub-gallery 3 which is formed in the engine body E. To the side face of the engine body E there is secured an oil filter F. The lubricating oil pumped through the sub-gallery 3 passes through the oil filter and then to the main gallery 2 which is formed in the engine body E. The lubricating oil is then shunted from the main gallery 2 into branched oil supply passages, from which it is supplied to the parts to be lubricated, such as the bearing of the crankshaft or the valve actuating cam shaft, or both.

Figure 2:
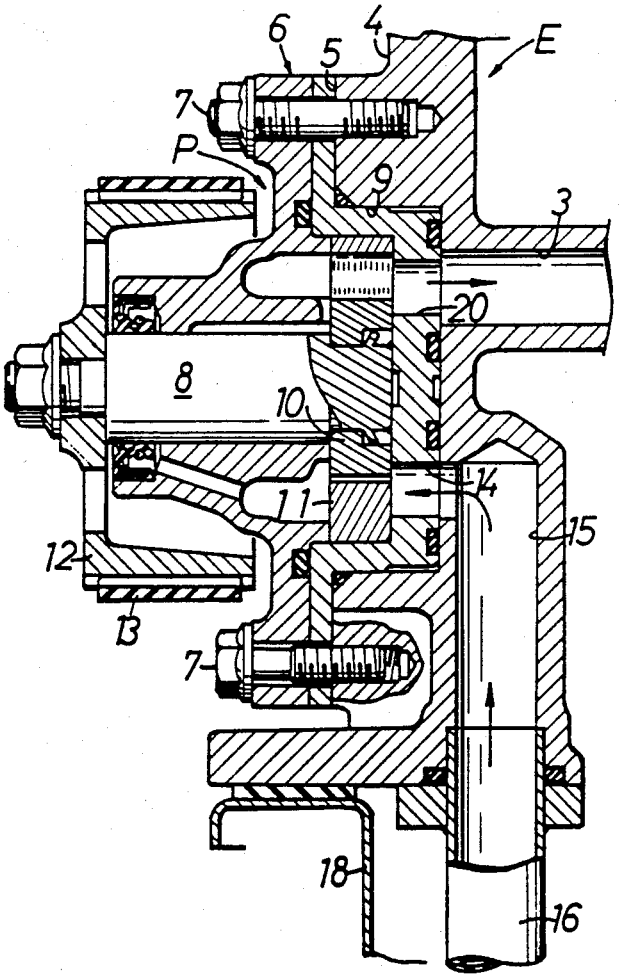
FIG. 2 is a sectional detail partly broken away, taken substantially on the lines II—II as shown on FIG. 1.

The oil pump P is mounted on the outer face of an end wall 4 of the engine body E, which is normal to the crankshaft direction, so as to facilitate its drive from the crankshaft 1. As shown in FIG. 2, more specifically, the end wall 4 of the engine body E has its outer face formed with a mounting seat 5, to which a pump case 6 is fastened by means of a plurality of mounting bolts 7. In the pump case 6 thus fastened, there is rotatably borne a pump shaft 8 which is in parallel with the crankshaft 1 and by which inner and outer rotors 10 and 11 received in a recess 9 formed in the engine body E are driven. To the outer end of the pump shaft 8 there is secured a pulley 12 on which an endless transmission belt 13 made coactive with the crankhaft 1 is made to run so that the oil pump P is driven by the rotations of the crankshaft 1. The oil pump P has its suction port 14 communicating with a suction passage 15 which is formed in the engine body E. To this suction passage 15, as shown in FIG. 3, there is connected the upper end of a suction pipe 16, which has its lower end communicating with an oil reservoir 19 within an oil pan 18 by way of an oil strainer 17.

The oil pump P has its discharge port 20 communicating with the sub-gallery 3 which is formed in the engine body E. The sub-gallery 3 is so formed generally in a straight rib extending on the side wall 21 of the engine body E in the crankshaft direction. The sub-gallery 3 extends midway of the engine body E and its inner end, i.e., its outlet port 22 is opened in the outer face of the side wall 21. Above that sub-gallery 3, the side wall 21 is formed adjacent the main gallery 2 which also extends in the form of a rib-shaped land generally in parallel with the sub-gallery 3. The main gallery 2 thus formed is opened in both the end walls of the engine body E, which are normal to the crankshaft 1, and has both its open ends plugged by means of blind plugs 23 and 24.

Figure 4:
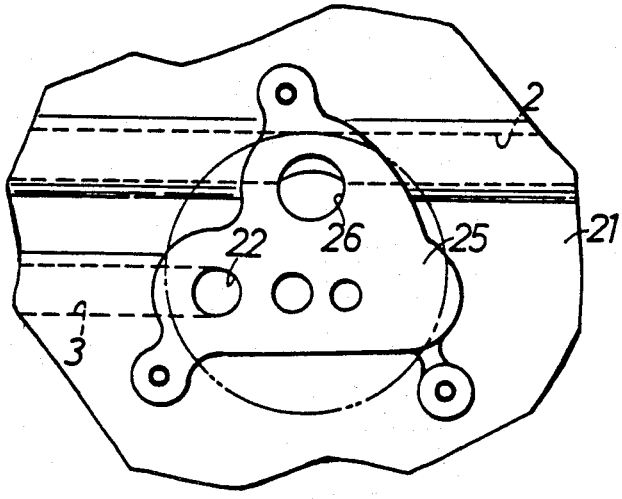
FIG. 4 is a side elevation taken substantially on the lines IV—IV as shown on FIG. 1.

The engine body E is formed at an intermediate portion of the side wall 21 in the axial direction of the crankshaft 1 with a mounting seat 25 for the oil filter F. As shown in FIG. 4, there are opened in the mounting seat both the outlet port 22 of the sub-gallery 3 and an inlet port 26 which has communication with the central portion of the main gallery 2. Thus, the lubricating oil from the sub-gallery 3 is supplied through the inlet port 26 to the main gallery 2 after it has been filtered through the oil filter F.

Figure 3:
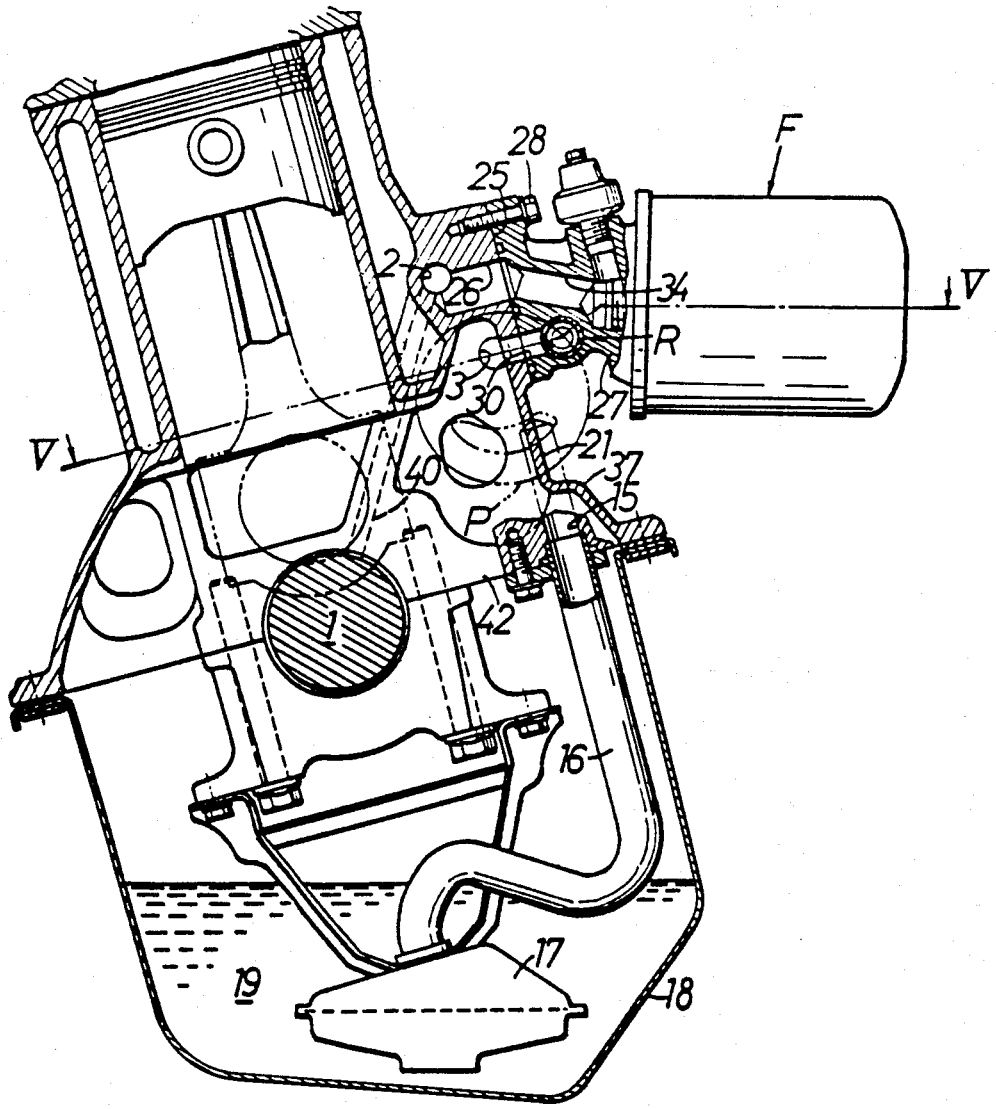
FIG. 3 is a transverse sectional view taken substantially on the lines III—III as shown on FIG. 1.
Figure 5:
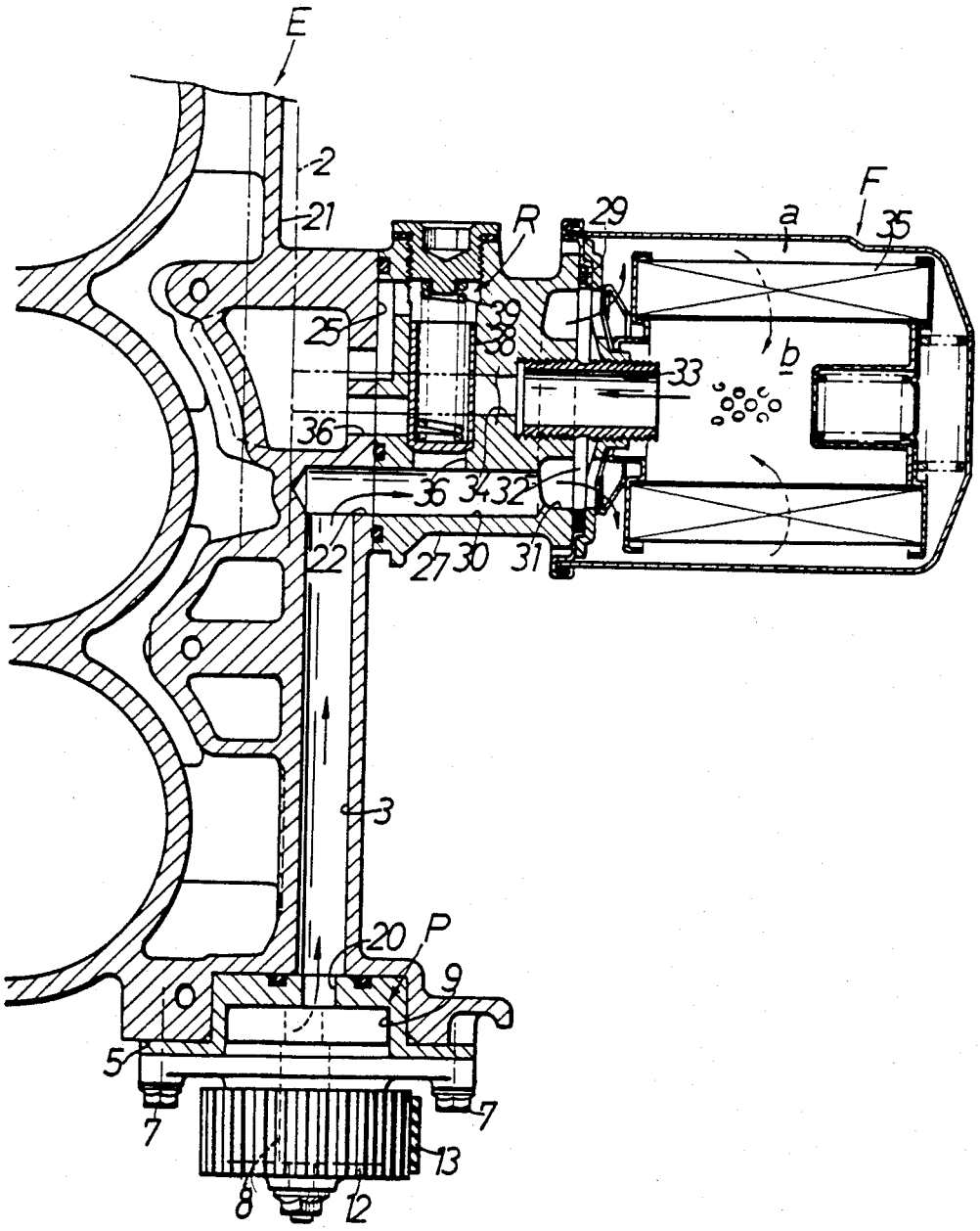
FIG. 5 is a sectional view partly broken away, taken substantially on the lines V—V as shown on FIG. 3.

As clearly seen from FIGS. 3 and 5, there is fastened to the mounting seat 25 by means of a plurality of mounting bolts 28 a mounting base 27 having a mounting face, in which the oil filter F is threaded through a sealing member 29. The mounting base 27 is formed with an inlet passage 30, which leads to the outlet port 22 of the sub-gallery 3, and an annular passage 31 which has communication with the inlet passage 30. That annular passage 31 opens into the mounting base 27 and has communication with the inlet 32 of the oil filter F. This oil filter F has its outlet 33 communicating with the inlet port 26 of the aforementioned main gallery 2 by way of an outlet passage 34 which is formed in the mounting base 27. Within the oil filter F there is accommodated a cylindrical filter element 35. An unclean chamber a, which is formed outside of that element 35, is made to have communication with the inlet passage 30 through the annular passage 31, and a clean chamber b, which is formed inside of the filter element 35, is made to communicate with the outlet passage 34. The lubricating oil from the outlet port 22 of the sub-gallery 3 flows through the inlet passage 30 and the annular passage 31 into the unclean chamber a of the oil filter F, and is there filtered through the filter element 35. After that, the lubricating oil flows into the clean chamber b, from which it further flows through the outlet passage 34 and the inlet port 26 into the main gallery 2.

Mounting base 27 is equipped, as shown in FIG. 5, with a regulator R for regulating the pressure of the lubricating oil. More specifically, the mounting base 27 is provided with a bypass passage 36 which has communication with the inlet passage 30 and which opens into the crankcase 37 (FIG. 3). In the bypass passage 36, there is slidably fitted a piston-shaped valve member 38 for controlling the size of the opening of that bypass passage 36. A valve spring 39 is placed under compression between that valve member 38 and the inner wall of the mounting base so that the valve member 38 is retracted against the elastic force of the valve spring 39 to open the bypass passage 36 when the pressure of the lubricating oil flowing through the inlet passage 30 exceeds a predetermined value. Thus, the lubricating oil is returned through that bypass passage 36 to the crankcase 37, i.e., the oil pan 18.

Figure 6:
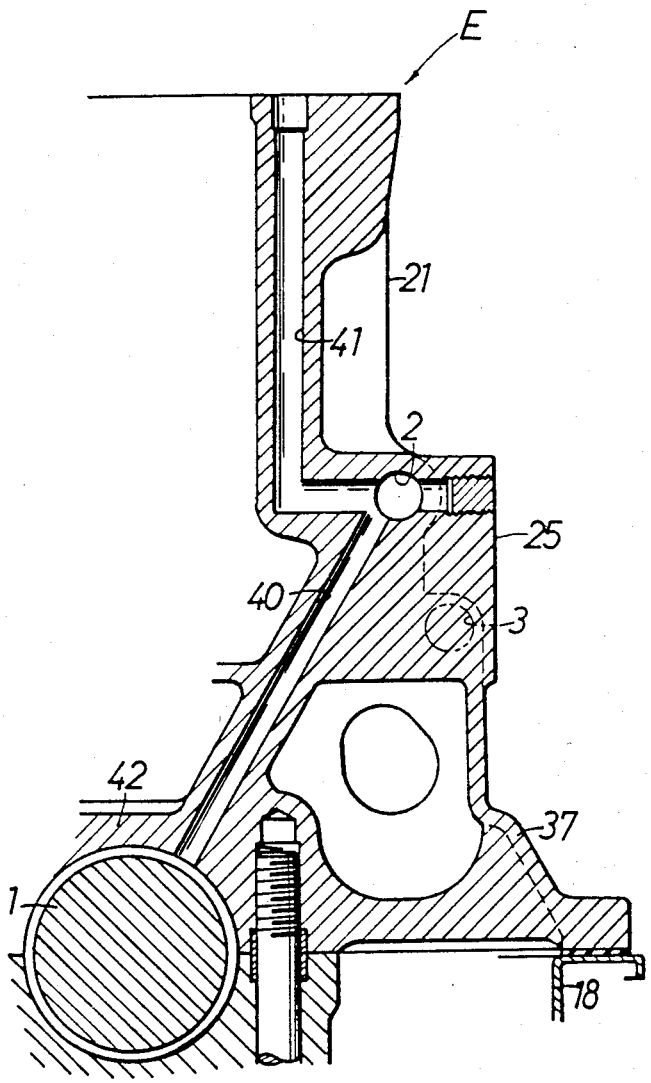
FIG. 6 is a sectional detail taken substantially on the lines VI—VI as shown on FIG. 1.

As shown in FIG. 6, the main gallery 2 is made to communicate with a plurality of lower branched oil supply passages 40 which are formed in the engine body E at longitudinally spaced locations. The lower branched oil supply passages 40 thus formed open through crank journal walls 42 in the bearing face of the crankshaft 1. The central portion of the main gallery 2 communicates with an upper branched oil supply passage 41 which is provided in the engine body E and which delivers oil to the valve actuating mechanism (not shown) above the engine body E.

When the internal combustion engine is operating, the oil pump P is driven by the rotations of the crankshaft 1 through the transmission belt 13 and the pulley 12. The lubricating oil in the oil pan 18 is primarily filtered by the oil strainer 17, and is then sucked up through the suction pipe 16 and is pumped out of the discharge port 20 to the sub-gallery 3 in the engine body E. The lubricating oil under pressure through the sub-gallery 3 flows from the outlet port 22 through the inlet passage 30 and the annular passage 31 of the mounting base 27 into the oil filter F. The lubricating oil in said filter F is secondarily filtered from the unclean chamber a through the filter element 35 until it flows through the clean chamber b at the inner side from the outlet 33. It then flows through the outlet passage 34 of the mounting base 27 into the main gallery 2 which is formed in engine body E. The clean lubricating oil in the main gallery 2 is shunted to the right and left by the inlet port 26 of the main gallery 2. The lubricating oil passes through the branched oil supply passages 40 to the bearing faces of the crankshaft 1, and through the upper branched oil supply passage 41 to the bearing faces of the valve actuating cam shaft of the valve actuating mechanism.

If the pressure of the lubricating oil flowing through the flow system exceeds a preset level, the regulator R, which is disposed in the bypass passage 36 and communicates with the inlet passage of the mounting base 27, is opened, as above. The valve member 38 is retracted to short-circuit the inlet passage 30 through the bypass passage 36 into the crankcase 37 (FIG. 3). The flow system of the lubricating oil is made to communicate with the oil reservoir 19 in the crankcase 37, thereby to make it impossible to increase the pressure of the lubricating oil in said flow system above a predetermined level.

As is apparent from the embodiment thus far described, according to the present invention, the side wall of the engine body in the crankshaft direction is formed generally in parallel with the crankshaft with both the straight sub-gallery for providing communication with the discharge port of the oil pump and the inlet of the oil filter and the straight main gallery having communication with the outlet of the oil filter. As a result, those galleries have their passage shapes so remarkably simplified as to reduce manufacturing costs. The plural branched oil supply passages, which are branched from the main gallery and opened in the respective portions to be lubricated, can also be formed with marked ease. Thus, it is possible to reduce the production cost for the engine body itself.

Since the main gallery and the sub-gallery are formed in the side wall of the engine body, moreover, said side wall can have its strength enhanced, notwithstanding that it is relatively thin, while providing little increase in the weight of the engine body.

It will be noted that the oil filter is mounted below the engine body by arranging the sub-gallery below the main gallery so that its clearance from the intake manifold, which is arranged just above said oil filter, can be substantially retained to improve the maintainability of the oil filter. Because of the close arrangements of the main gallery and the sub-gallery, moreover, it is possible to simplify the shapes of both the mounting seat of the oil filter and the lubricating oil passage formed in the mounting seat.

Having fully described our invention, it is to be understood that we are not to be limited to the details herein set forth but that our invention is of the full scope of the appended claims.

We claim:

1. In an internal combustion engine having a crankshaft, a side wall parallel to the crankshaft, and having an end wall normal to the crankshaft, the improvement comprising, in combination: a lubricating oil pump on the outer face of said end wall and adjacent said side wall, an oil filter on the outer face of and located substantially midway of the length of said side wall, a substantially straight sub-gallery in said side wall establishing communication between said oil pump and said oil filter, a substantially straight main gallery in said side wall and substantially parallel to the crankshaft for the full length of said side wall, said main gallery connected to said oil filter to receive lubricating oil from said oil filter, and a plurality of branched oil supply passages connecting said main gallery to parts of the engine to be lubricated.

* * * * *